US005829258A

United States Patent [19]

Cho

[11] Patent Number: 5,829,258

[45] Date of Patent: Nov. 3, 1998

[54] MULTI-STEP PRESSURE REDUCING METHOD AND APPARATUS

[75] Inventor: Nam-sik Cho, Kyungki-do, Rep. of Korea

[73] Assignee: Samsung Electronics Co., Ltd., Suwon, Rep. of Korea

[21] Appl. No.: 922,396

[22] Filed: Sep. 3, 1997

[30] Foreign Application Priority Data

Sep. 4, 1996 [KR] Rep. of Korea ..... 96-38273

[51] Int. Cl.[6] ..... F25B 19/00

[52] U.S. Cl. ..... 62/100; 62/268; 417/244

[58] Field of Search ..... 62/100, 268; 417/244, 417/423.5

[56] References Cited

U.S. PATENT DOCUMENTS

| | | | |
|---|---|---|---|
| 3,304,733 | 2/1967 | Coffman | 62/100 |
| 4,361,418 | 11/1982 | Tscheppe | 417/244 |
| 4,942,053 | 7/1990 | Franklin et al. | 62/100 |

*Primary Examiner*—Ronald C. Capossela
*Attorney, Agent, or Firm*—Burns, Doane, Swecker & Mathis, L.L.P.

[57] ABSTRACT

The air pressure in a part of an appliance (e.g., a refrigeration pipe of an air conditioner unit) is reduced as the part is conveyed on a conveyor. This is accomplished by means of a vacuum pump which is connected to the part by a hose. The pressure reduction is achieved in a step-by-step fashion by either (a) alternately starting and stopping the pump while the hose remains connected to the part, or (b) alternately connecting and disconnecting the hose to and from the part.

7 Claims, 7 Drawing Sheets

FIG.5

| Pressure reduction time | 1 | 2 | 2.5 | 3 | 3.5 | 4 | 5 | 5.5 | 6 | 7 | 7.5 | 10 | 15 |
|---|---|---|---|---|---|---|---|---|---|---|---|---|---|
| continuous pressure reduction | 0.45 | 0.23 | 0.18 | 0.14 | 0.10 | 0.09 | 0.07 | 0.065 | 0.065 | 0.065 | 0.065 | 0.06 | 0.045 |
| T2-step pressure reduction | 0.45 | 0.23 | 0.17 | 0.12 | 0.095 | 0.18 | 0.065 | 0.23 | 0.14 | 0.08 | 0.07 | 0.048 | - |
| T3-step pressure reduction | 0.44 | 0.23 | 0.15 | 0.11 | 0.25 | 0.19 | 0.09 | 0.09 | 0.23 | 0.10 | 0.08 | 0.045 | - |
| T4-step pressure reduction | 0.45 | 0.23 | 0.48 | 0.23 | 0.17 | 0.11 | 0.22 | 0.22 | 0.10 | 0.06 | 0.20 | 0.045 | - |

MULTI-STEP PRESSURE REDUCING METHOD AND APPARATUS

RELATED INVENTION

This invention is related to an invention disclosed in commonly filed U.S. application Ser. No. 08/922,397 (attorney docket no. 031995-003), the disclosure of which is incorporated by reference herein.

BACKGROUND OF THE INVENTION

1. Field of the Invention

The present invention relates to a pressure reducing method and apparatus for vacuumizing a part which requires a vacuum (hereinafter, referred to as "vacuum-requiring part").

2. Description of the Related Art

Among various appliances, a typical example of an appliance which must be vacuumized during a certain manufacturing process before it is introduced into a next process, is an outdoor unit of an air conditioner.

The outdoor unit of an air conditioner generally has a compressor and a condenser, which are connected to a refrigerant pipe and a capillary tube, respectively. The compressor and the condenser of the outdoor unit cooperate with an evaporator of an indoor unit, to complete a refrigerating cycle.

The air conditioner having the outdoor unit and the indoor unit installed outdoors and indoors, respectively, is generally brought into the market in a state that the refrigerant, being a noxious substance, is filled in the refrigerant pipe of the outdoor unit, for the sake of safety, upon installation. While assembling the outdoor unit in a factory, a process for removing moisture and foreign materials which may exist in the refrigerant pipe is generally carried out to avoid contamination of the refrigerant when the refrigerant is subsequently introduced into the refrigerant pipe.

The process for removing moisture and foreign materials from the refrigerant pipe of the outdoor unit, is substantially performed by reducing a pressure in the refrigerant pipe to a vacuum level, and this vacuumizing operation for the refrigerant pipe is effected by connecting the refrigerant pipe to a vacuum pump while the refrigerant pipe is moved on a conveyor in an assembling line.

FIG. 1 illustrates a conventional pressure reducing apparatus which can be used for reducing a pressure in a refrigerant pipe of an outdoor unit. Referring to FIG. 1, the conventional pressure reducing apparatus includes a plurality of vacuum pumps 1, a plurality of cages 2 for supporting the respective vacuum pumps 1 thereon, a cage rail 3 for guiding movement of the cages 2, and an electric power supply rail 4 for supplying an electric power to the vacuum pumps 1. The drawing reference numeral 6 designates a pallet on which an outdoor unit 5 of an air conditioner is loaded and conveyed.

Referring to FIG. 2, the cages 2 are suspended from the cage rail 3 by rollers 8, and are coupled to a chain 9 arranged beneath the cage rail 3, such that each cage 2 is separated from other adjacent cages 2 by a constant distance. The cages 2 are moved along the cage rail 3 together with the chain 9 which is driven by a chain driving portion 10 (see FIG. 1).

The distance between two adjacent cages 2 moved along the cage rail 3 and a moving velocity of each cage 2 are set to be the same as a distance between two adjacent outdoor units 5 conveyed on a conveyor 7 and a conveying velocity of each outdoor unit 5, respectively.

The vacuum pump 1 equipped onto the cage 2 is supplied with the electric power through a cable connected by a sliding brush 11 to the electric power supply rail 4. First ends of a pair of vacuum hoses 12 are connected to a pair of output ports of the vacuum pump 1. A pair of quick couplings 13 are provided on other ends of the vacuum hoses 12 and are connected to the ends of refrigerant pipes 14 of the outdoor unit 5 conveyed on the conveyor 7, respectively.

In FIG. 2, the drawing reference numerals 15 and 16 respectively designate a pair of cord reels and a pair of cords elastically wound around the cord reels. The cords 16 function to pull up the vacuum hoses 12 above the conveyor 7, so as not to hinder any other operations when the vacuum hoses 12 are disconnected from the refrigerant pipes 14.

Hereinafter, a pressure reducing method performed by using the conventional pressure reducing apparatus constructed as mentioned above will be described with reference to FIG. 3:

Referring to FIG. 3, in a moving track of the vacuum pump 1, a straight section between points A and B, adjacent to the conveyor 7, represents a current-carrying region of the electric power supply rail 4, in which the electric power is supplied to the vacuum pump 1. In the remainder of the electric power supply rail 4, electric power is not supplied to the vacuum pump 1.

When the outdoor unit 5, after passing through several processes, is introduced into one end of the conveyor 7 adjacent the point A which is a starting point of the current-carrying region of the electric power supply rail 4, the vacuum hoses 12 already connected to the vacuum pump 1, are connected to respective refrigerant pipes 14 of the outdoor unit 5 by a worker 18*a* positioned close to the point A. As the vacuum pump 1 moves at the same velocity as the outdoor unit 5 from point A to point B, a pressure reducing operation for the refrigerant pipes 14 by the vacuum pump 1 is undertaken.

The pressure reducing operation for the refrigerant pipes 14 by the vacuum pump 1 is continued until the respective outdoor unit 5 conveyed on the conveyor 7 reaches the point B which is an end point of the current-carrying region of the electric power supply rail 4. After the outdoor unit 5 passes through the point B, the hoses 12 are disconnected from the refrigerant pipes 14 of the outdoor unit 5 by another worker 18*b* positioned close to the point B. By this, the pressure reducing operation for the refrigerant pipe 14 by the vacuum pump 1 is completed.

However, in the conventional pressure reducing method and apparatus, the vacuum pump 1 performs the pressure reducing operation continuously without any interruption, while the vacuum hoses are connected to the refrigeration pipes. Thus, the efficiency of the vacuum pump 1 is less than desired, and it takes a relatively long time for a pressure in the refrigerant pipe 14 of the outdoor unit 5 to be reduced to a desired vacuum level.

Since a time for vacuumizing the refrigerant pipe 14 is lengthy, a time for assembling the outdoor unit 5 is also lengthy, and thereby productivity is severely minimized.

Also, if the required time for vacuumizing the refrigerant pipe 14 is lengthy, as described above, the current-carrying region for the electric power supply rail 4 must also be lengthy, which causes the required number of vacuum pumps 1 to be relatively large. As a result, the cost for fabricating the pressure reducing apparatus increases.

SUMMARY OF THE INVENTION

The present invention has thus been constructed to overcome one or more of the above described problems of the conventional art. Accordingly, it is an object of the present invention to provide a pressure reducing method and apparatus which is capable of remarkably shortening a time for a vacuum-requiring part to reach to a desired vacuum level.

According to one aspect of the present invention, there is provided a multi-step pressure reducing apparatus comprising: a plurality of cages; a plurality of vacuum pumps equipped onto each cage; a plurality of vacuum hoses each having one end separatably connected to a vacuum-requiring part of an appliance conveyed on a conveyor and the other end connected to a vacuum pump; a cage moving means for moving the cages in the same moving direction and velocity as the conveyor; and a vacuum pump intermittent operating means for intermittently supplying an electric power to the vacuum pumps.

According to another aspect of the present invention, the cage moving means includes a chain to which the cages are coupled such that a predetermined distance is defined between two adjacent cages; a chain driving portion for driving the chain; and a cage rail for guiding movement of the cages.

According to still another aspect of the present invention, the vacuum pump intermittent operating means includes an electric power supply rail for intermittently supplying the electric power to the vacuum pumps, the electric power supply rail being disposed in a side by side relationship with the cage rail and having the current-carrying regions and the non-current-carrying regions, which are alternately formed; and an electric power supply cable having one end connected to the vacuum pump and the other end connected to the electric power supply rail through a brush.

According to yet still another aspect of the present invention, there is also provided a multi-step pressure reducing method comprising the steps of: connecting one end of a vacuum hose to a vacuum-requiring part of an appliance conveyed on a conveyor and the other end of the vacuum hose to a vacuum pump moved in the same moving direction and velocity as the conveyor; intermittently supplying a vacuum to the part to multi-stepwise reduce a pressure in the vacuum-requiring part. The intermittent supply of vacuum can be accomplished by alternately performing at least two times an electric power supply process and an electric power shut-off process to the vacuum pump; and disconnecting one end of the vacuum hose from the vacuum-requiring part after a pressure reducing operation for the vacuum-requiring part by the vacuum pump is completed.

An alternative way of intermittently supplying the vacuum is to alternately connect and disconnect the hose to and from the part as the part is being conveyed.

By the features of the present invention, there is provided an advantage in that a pressure in a refrigerant pipe can be reduced to a desired vacuum level in a short time.

BRIEF DESCRIPTION OF THE DRAWINGS

The above object, and other features and advantages of the present invention will become more apparent by describing in detail preferred embodiments thereof with reference to the accompanying drawings, in which:

FIG. 5 is a table for comparing vacuumizing times achieved by the present multi-step pressure reducing apparatus and the conventional pressure reducing apparatus;

DETAILED DESCRIPTION OF PREFERRED EMBODIMENTS OF THE INVENTION

Figure 1:
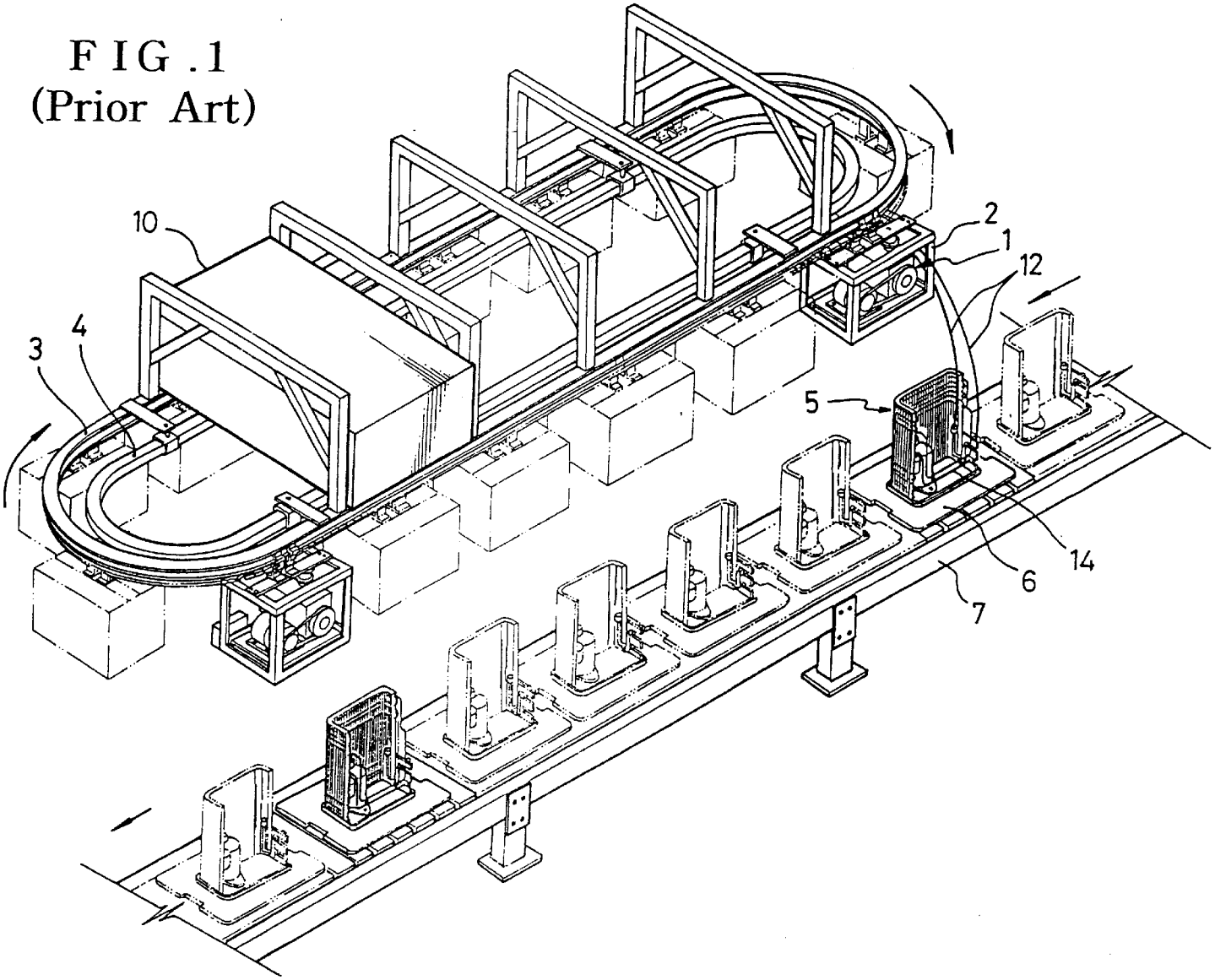
FIG. 1 (Prior Art)
FIG. 1 is a top perspective view of a conventional pressure reducing apparatus.

Reference will now be made in greater detail to preferred embodiments of the invention, examples of which are illustrated in the accompanying drawings. This invention may, however, be embodied in many different forms and should not be construed as limited to the embodiments set forth herein; rather, these embodiments are provided so that this disclosure will be through and complete, and will fully convey the scope of the invention to those skilled in the art. Wherever possible, the same reference numerals will be used throughout the drawings to refer to the same or like parts.

Figure 4:
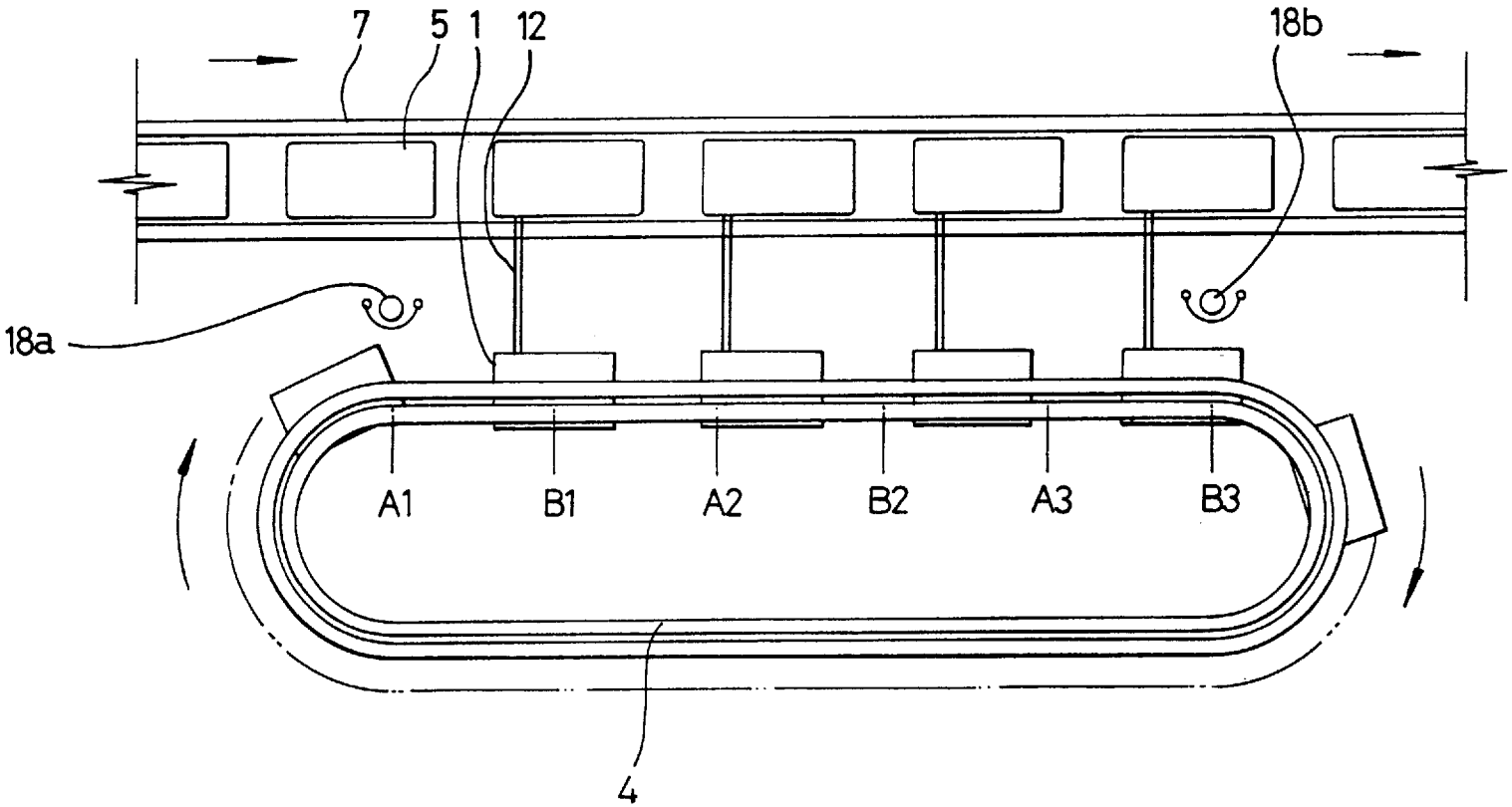
FIG. 4 is a top plan view of a multi-step pressure reducing apparatus in accordance with an embodiment of the present invention.

Referring to FIG. 4, in a multi-step pressure reducing apparatus in accordance with an embodiment of the present invention, the current-carrying section of the electric power supply rail 4 is divided into three current-carrying regions between points A1 and B1, A2 and B2, and A3 and B3. By this, two non-current-carrying regions are formed between the points B1 and A2, and B2 and A3.

A multi-step pressure reducing method is conducted by using the multi-step pressure reducing apparatus according to the present invention. First ends of the vacuum hoses 12 are permanently connected to the vacuum pump 1 whereas second ends of the hoses are temporarily connected to the ends of respective refrigerant pipes 14 of the outdoor unit 5 of the air conditioner by a worker 18*a* positioned close to the point A1 which is a starting point of the first current-carrying region of the electric power supply rail 4. The second ends of the vacuum hoses 12 are disconnected from the refrigerant pipes 14 of the outdoor unit 5 by another worker 18*b* positioned close to the point B3 which is an end point of the last current-carrying region of the electric power supply rail 4.

In other words, in the multi-step pressure reducing apparatus of the present invention, since the current-carrying section of the electric power supply rail 4 is divided into three current-carrying regions between points A1 and B1, A2 and B2, and A3 and B3 and two non-current-carrying regions are formed between points B1 and A2, and B2 and A3, a pressure in the refrigerant pipe 14 of the outdoor unit 5 can be reduced over three steps between points A1 and B1, A2 and B2, and A3 and B3, by the vacuum pump 1.

Here, the shutting-off of current from the rail 4 to each of the pumps 1 in the two non-current-carrying regions B1→A2 and B2→A3 to achieve the intermittent operation of the vacuum pump 1 can be effected in any suitable way, e.g., by using a timer, or sensors or the like.

Although three pump-on zones and two pump-off zones have been described, suitable numbers of such zones can be determined through experiments for a given vacuum-requiring part of an appliance.

As can be readily seen from the drawings, because the construction of the multi-step pressure reducing apparatus according to the present embodiment is basically the same as that of the conventional pressure reducing apparatus, except for the differences explained hereinbefore, a further description thereof will be omitted.

Experiments were carried out for an outdoor unit (Model: AP-2536 OUT) of a separation type air conditioner manufactured by Samsung Electronics, Co., Ltd. who is an assignee of the subject application, by using the present multi-step pressure reducing method while varying the intermittent operation periods of the vacuum pump 1 during three tests identified as T2, T3 and T4, and the results thereof were compared with the result obtained using the conventional pressure reducing method. The results are set out in FIGS. 5 and 6.

Figure 6:
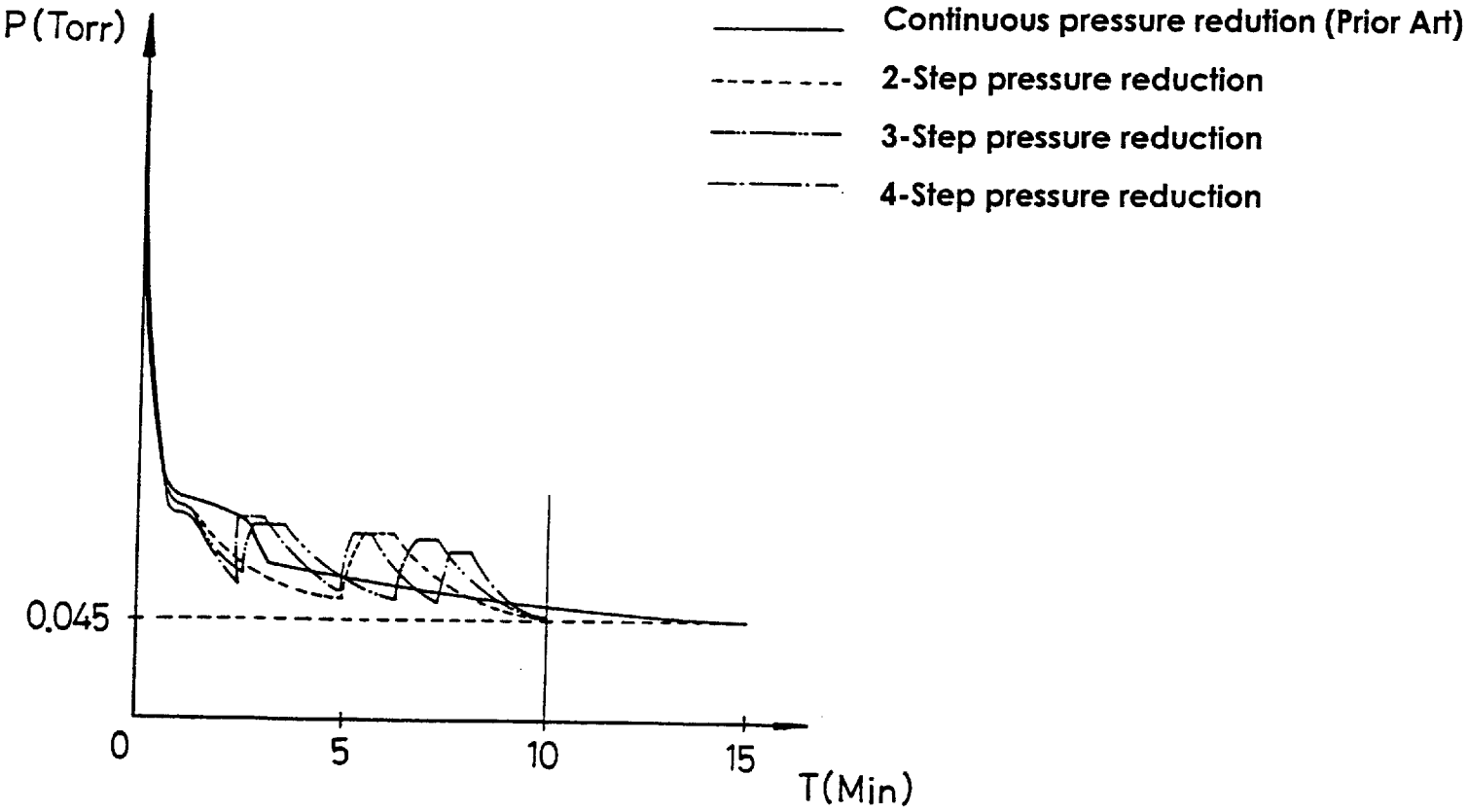
FIG. 6 is a graph for comparing vacuumizing times achieved by the present multi-step pressure reducing apparatus and the conventional pressure reducing apparatus.

Referring to FIGS. 5 and 6, it will be readily understood that, to obtain a vacuum pressure of 0.045 Torr, it takes about 15 minutes for the conventional pressure reducing method, while it takes about 10 minutes for the multi-step pressure reducing method according to the present invention.

In FIG. 6, it can be seen that, when reducing a pressure in the refrigerant pipe 14 of the outdoor unit 5 by the vacuum pump 1, a rate of pressure reduction in the refrigerant pipe 14 is high during an initial period of pump operation, and that rate of pressure reduction gradually levels off with the lapse of time.

Since the present invention uses this quick pressure-reduction phenomenon a number of times during the pressure reducing operation, as compared to only once for the prior art, it becomes possible to cause the refrigerant pipe 14 to reach a desired vacuum level in a shorter time as compared with the conventional pressure reducing method and apparatus.

Therefore, by the multi-step pressure reducing method and apparatus according to the present invention, a time for vacuumizing the refrigerant pipe 14 of the outdoor unit 5 is shortened, a time for assembling the outdoor unit 5 can be also shortened, and thereby productivity can be extraordinarily improved.

Further, as described above, by the multi-step pressure reducing method and apparatus according to the present invention, because the time for vacuumizing the refrigerant pipe 14 of the outdoor unit 5 is shortened, a length of the current-carrying section of the electric power supply rail 4 can also be shortened, and thereby a cost for fabricating the pressure reducing apparatus can be decreased.

Additionally, by the multi-step pressure reducing method and apparatus according to the present invention, when the pressure reducing operation by the vacuum pump 1 is temporarily halted, some outside air can flow into the refrigerant pipe 14 of the outdoor unit 5 so that the pressure in the refrigerant pipe 14 can be somewhat raised. Thanks to this fact, the foreign materials adhered to an inner surface of the refrigerant pipe 14 are apt to be removed therefrom due to pressure variation. Accordingly, when the pressure reducing operation by the vacuum pump 1 restarts, the foreign materials can be easily discharged out of the refrigerant pipe 14.

Figure 2:
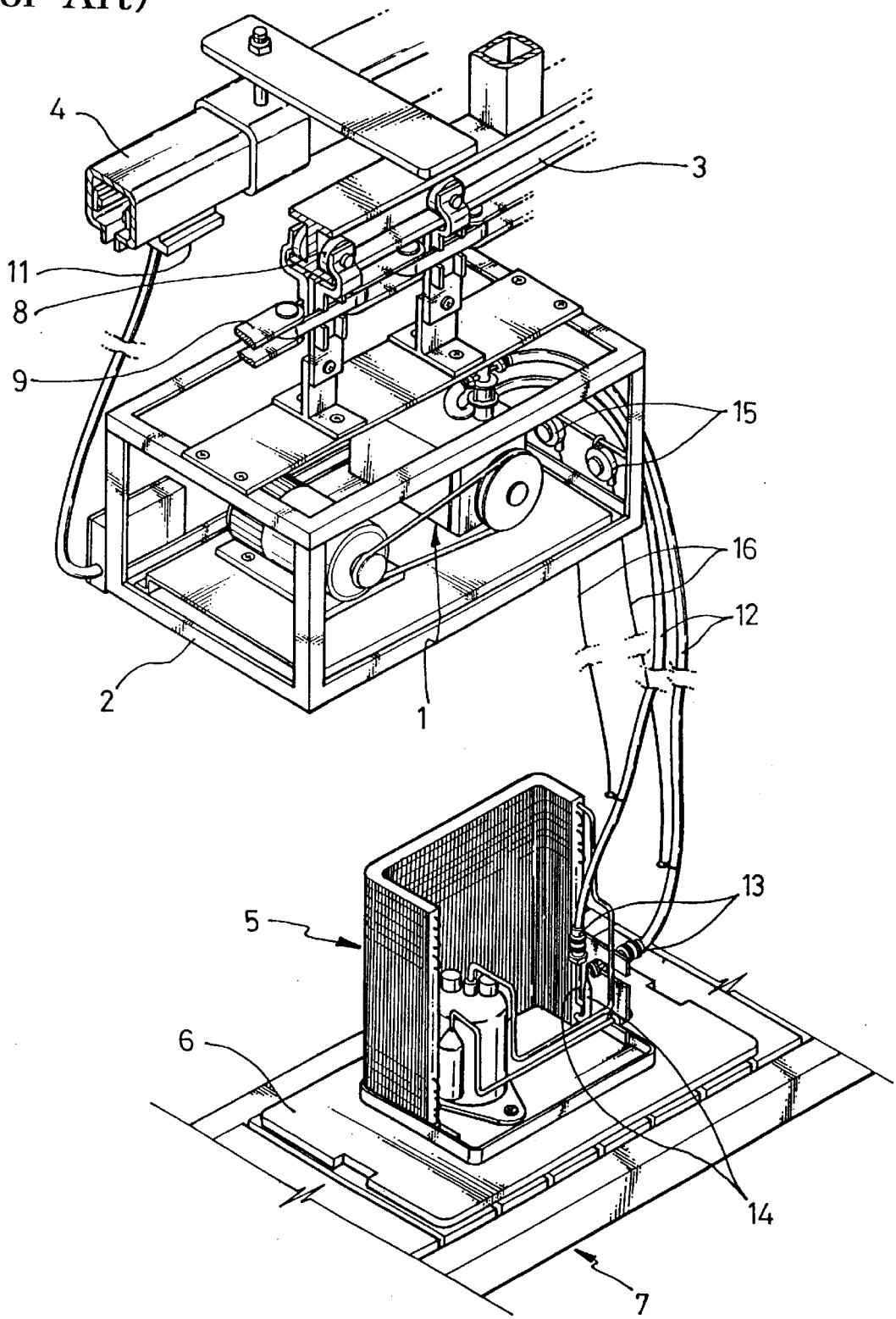
FIG. 2 (Prior Art)
FIG. 2 is an enlarged top perspective view of a main construction of the conventional pressure reducing apparatus of FIG. 1.
Figure 3:
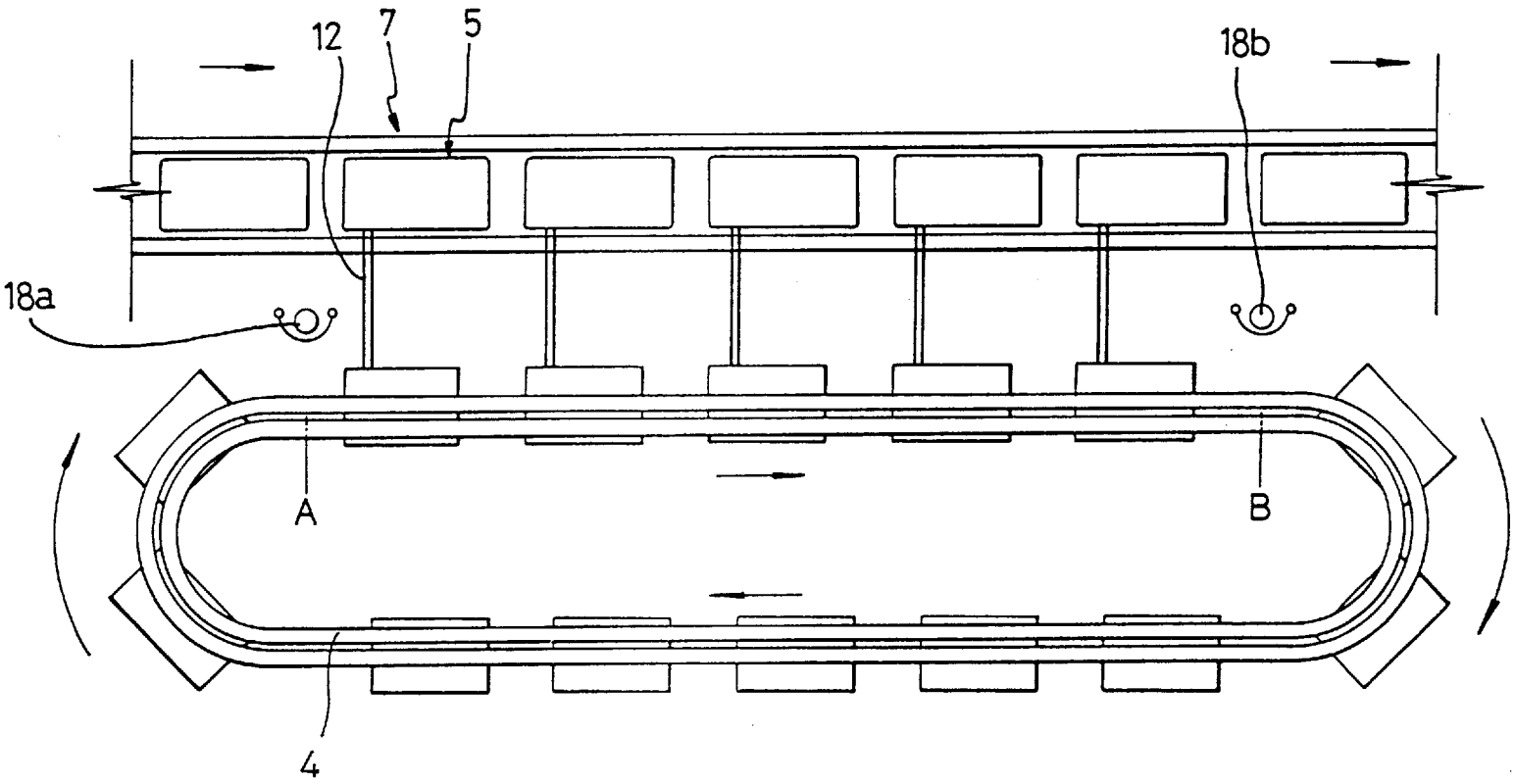
FIG. 3 (Prior Art)
FIG. 3 is a top plan view of the conventional pressure reducing apparatus of FIG. 1.
Figure 7:
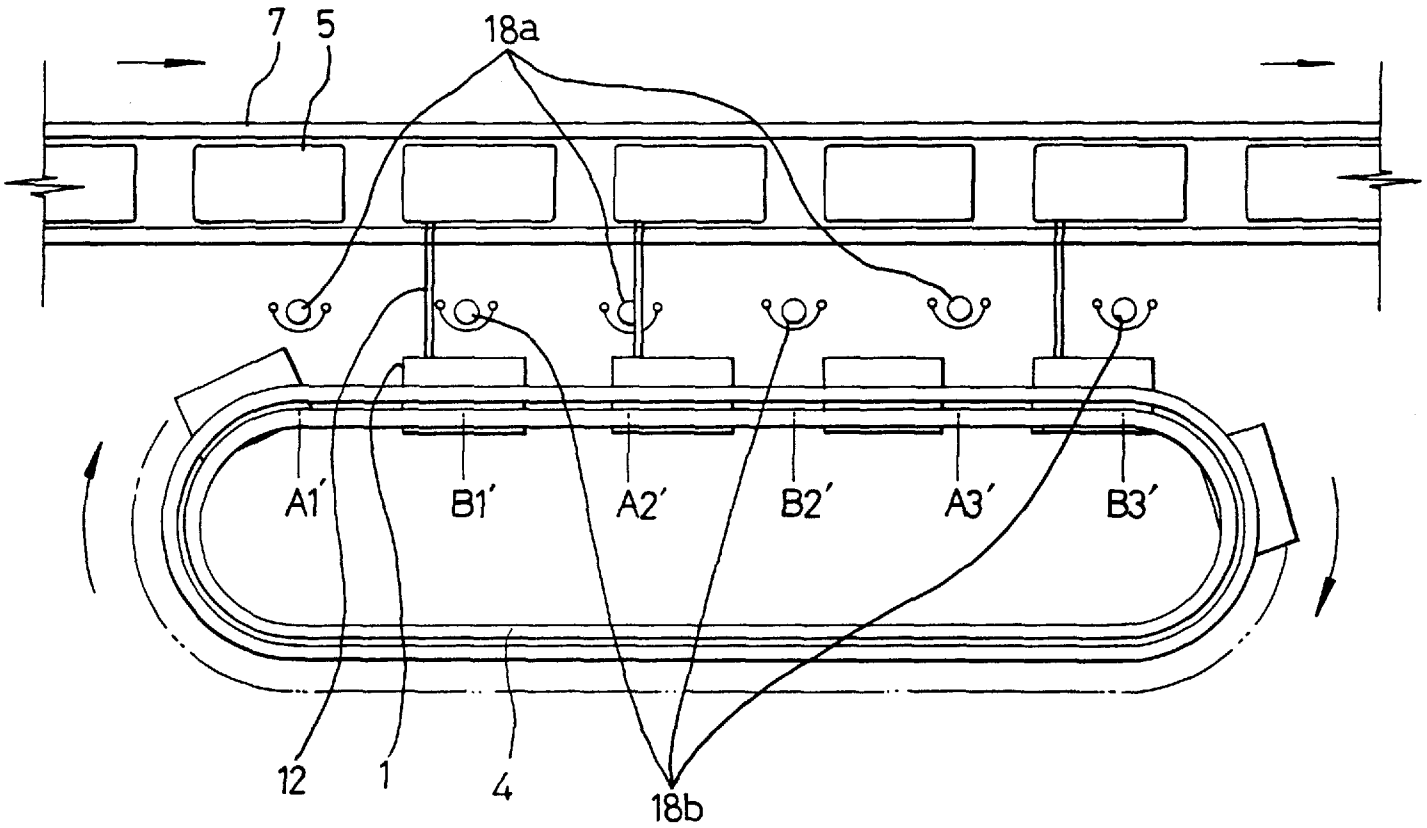
FIG. 7 is a top plan view of a multi-step pressure reducing apparatus in accordance with another embodiment of the present invention.

FIG. 7 is a plan view for explaining another multi-step pressure reducing method using the conventional pressure reducing apparatus as shown in FIGS. 1 through 3.

Referring to FIG. 7, the multi-step pressure reducing method of the present invention can be implemented using the conventional apparatus. That is, the entire section between points A1' and B3' of the electric power supply rail 4 supplies current to the pumps, as in the conventional pressure reducing apparatus ends of the vacuum hoses 12 (the first ends connected to the vacuum pump 1) are connected to respective refrigerant pipes 14 of the outdoor unit 5 of the air conditioner by respective workers 18*a* positioned close to points A1', A2' and A3', and are disconnected from the refrigerant pipes 14 by other workers 18*b* positioned close to points B1', B2' and B3'.

The outdoor unit 5 of the air conditioner, after passing through several processes, is conveyed through the current-carrying section between A1' and B3', while the workers 18*a* positioned close to the points A1', A2' and A3' connect the vacuum hoses 12 to the refrigerant pipes 14 of the outdoor unit 5, and other workers 18*b* positioned close to the points B1', B2' and B3' disconnect the vacuum hoses 12 from the refrigerant pipes 14. In that way, the multi-step pressure reducing method using the conventional pressure reducing apparatus can be effected.

Accordingly, while the vacuum pump 1 is continuously operated throughout the entire current-carrying section between points A1' and B3' of the electric power supply rail 4, the refrigerant pipes 14 of the outdoor unit 5 is connected to the vacuum pump 1 only in regions between points A1' and B1', A2' and B2', and A3' and B3', and is disconnected from the vacuum pump 1 in regions between points B1' and A2', and B2' and A3'.

While the present invention has been particularly shown and described with reference to the particular embodiments above, those skilled in the art should understand that various changes and modifications in form and details may be effected therein without departing from the spirit and scope of the invention as defined by the appended claims and their equivalents.

What is claimed is:

1. Apparatus for reducing pressure in a vacuum-requiring part of an appliance, comprising:

a conveyor for conveying the parts;

cages arranged for movement parallel to the conveyor;

vacuum pumps mounted on respective cages;

a device mechanism for moving the cages at substantially the same velocity as the parts being conveyed;

vacuum hoses each having a first and connected to a respective one of the pumps, and a second end connected to a respective one of the parts for reducing pressure therein; and an operating mechanism for intermittently operating the pumps while the respective hoses are connected to the parts, for reducing the pressure in a number of steps.

2. The apparatus according to claim 1, further including a rail on which the cages are movably mounted in spaced apart relationship; the drive mechanism including a driven chain to which the cages are connected.

3. The apparatus according to claim 1, further including a cage rail on which the cages are movably mounted, and an electric power supply rail extending adjacent to the cage rail; electric cables each having one end connected to a respective pump and a second end connected to the electric supply rail by means of a sliding brush.

4. A method of reducing pressure step-by-step in a vacuum-requiring part of an appliance, comprising the steps of:

A) conveying the part; and

B) alternately bringing said part into and out of communication with a vacuum source wherein said part is brought into said communication at least two time while being conveyed.

5. The method according to claim 4 further comprising the step, prior to step B, of connecting the part to a vacuum pump by a vacuum hose.

6. The method according to claim 5 wherein step B comprises alternately turning said vacuum pump on and off.

7. The method according to claim 5 wherein step B comprises alternately connecting and disconnecting said hose to and from said part.

* * * * *